US006152781A

United States Patent [19]

Huang

[11] Patent Number: 6,152,781

[45] Date of Patent: Nov. 28, 2000

[54] ELECTRICAL CONNECTOR

[75] Inventor: Wayne Huang, Alhambra, Calif.

[73] Assignee: Hon Hai Precisdion Ind. Co., Ltd., Wei Te Chung

[21] Appl. No.: 09/374,072

[22] Filed: Aug. 12, 1999

[51] Int. Cl.[7] ..... H01R 13/502

[52] U.S. Cl. ..... 439/686; 439/733.1; 439/95

[58] Field of Search ..... 439/701, 686, 439/695, 607, 95, 101, 108, 733.1

[56] References Cited

U.S. PATENT DOCUMENTS

| | | | |
|---|---|---|---|
| 3,621,444 | 11/1971 | Stein | 439/733.1 |
| 4,802,868 | 2/1989 | Rolf et al. | 439/733.1 |
| 5,472,358 | 12/1995 | Tan et al. | 439/851 |
| 5,597,324 | 1/1997 | Katsunori | 439/686 |
| 5,722,861 | 3/1998 | Wetter | 439/701 |
| 5,727,957 | 3/1998 | Hashimoto et al. | 439/733.1 |

*Primary Examiner*—Gary F. Paumen
*Attorney, Agent, or Firm*—Wei Te Chung

[57] ABSTRACT

An electrical connector (20) comprises a dielectric housing (21) having front and rear surfaces (21*a*, 21*b*). An elongate slot (22) is defined in the rear surface (21*b*) and a plurality of passageways (23) extends from the slot (22) to the front face (21*a*). A bridging rib (2) is securely assembled to the elongate slot (22). A plurality of terminals (1) is integrally molded with the bridging rib (2). Each terminal (1) includes a retention portion (1*a*) integrally molded with the insert. A body portion (1*c*) extends from the retention portion (1*a*) and is received in the corresponding passageway (23). A tail portion (1*b*) extends rearward from the retention portion (1*a*), wherein the retention portion (1*a*) includes barbs (1*d*) exposed from the bridging rib (2) and engaged with an inner wall of the elongate slot (22) when the bridging rib (2) is inserted into the elongate slot (22).

2 Claims, 4 Drawing Sheets

ELECTRICAL CONNECTOR

FIELD OF THE INVENTION

The present invention relates to an electrical connector, and more particularly to an electrical connector with improved terminal coplanarity.

DESCRIPTION OF PRIOR ART

An electrical connector generally comprises a housing having a plurality of passageways for securely assembling terminals therein. In general, the terminals are directly inserted into the corresponding passageways and each terminal is formed with barbs to increase the interferential engagement with the passageway. Each terminal includes a mating portion remained in the passageway, and a tail portion extending outside the housing for soldering to a printed circuit board. A concern is raised for the coplanarity of the tails. Surface Mounting Technology (SMT) is a fully-developed technology and has been widely used in computer industry. However, when the terminals are inserted into the passageways, the tails are not always in a common plane since the terminal tends to pitch and roll within the passageway during the insertion. If the tails are not coplanar, the tails can not be fully connected to conductive pads on the printed circuit board through the SMT process.

U.S. Pat No. 5,597,324 discloses an improved receptacle connector wherein terminals are bonded to a stopper which in turn seal the housing thereby preventing the ingress of foreign particles into an IC card inserted thereto. Since the individual terminal (2) is not completely enclosed by the stopper, conductor extensions (2*b*) are not ensured in a common plane even the terminals are bonded by the stopper.

SUMMARY OF THE INVENTION

An objective of this invention is to provide an electrical connector having terminal with excellent coplanarity.

In order to achieve the objective set forth, an electrical connector in accordance with the present invention comprises a dielectric housing having front and rear surfaces. An elongate slot is defined in the rear surface and a plurality of passageways extends from the slot to the front face. A bridging rib is securely assembled to the elongate slot. A plurality of terminals is integrally molded with the bridging rib. Each terminal includes a retention portion integrally molded with the bridging rib. A body portion extends from the retention portion and is received in the corresponding passageway. A soldering tail extends rearward from the retention portion, wherein the retention portion includes barbs exposed from the bridging rib and engaged with an inner wall of the elongate slot when the bridging rib is inserted into the elongate slot.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
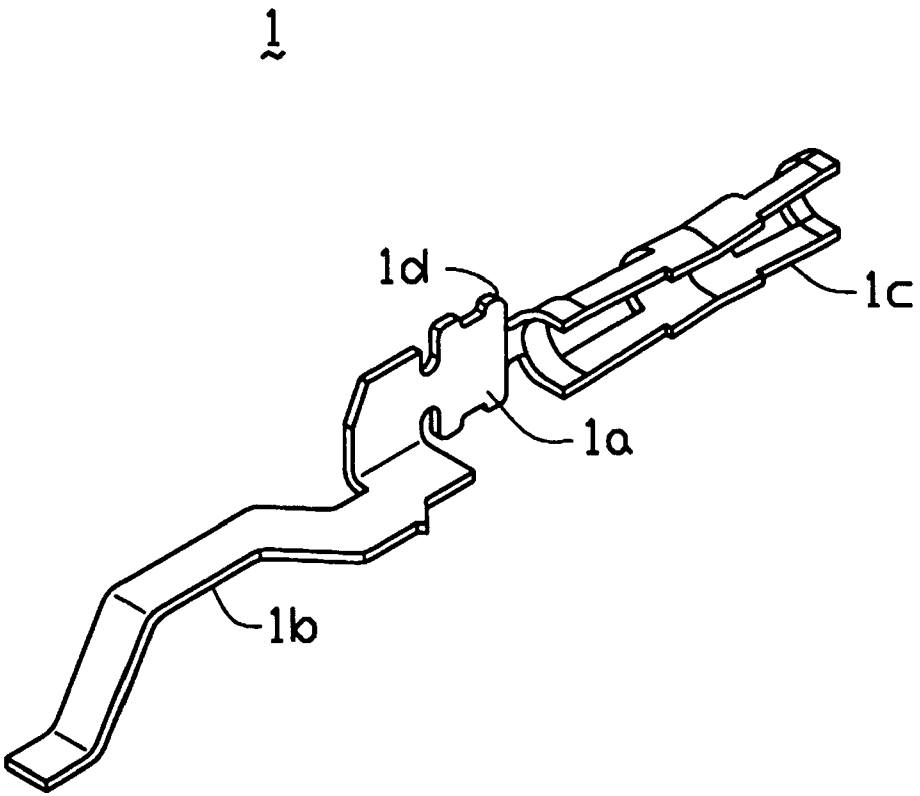
FIG. 1 is a perspective view of a socket contact used with the present invention.
Figure 2:
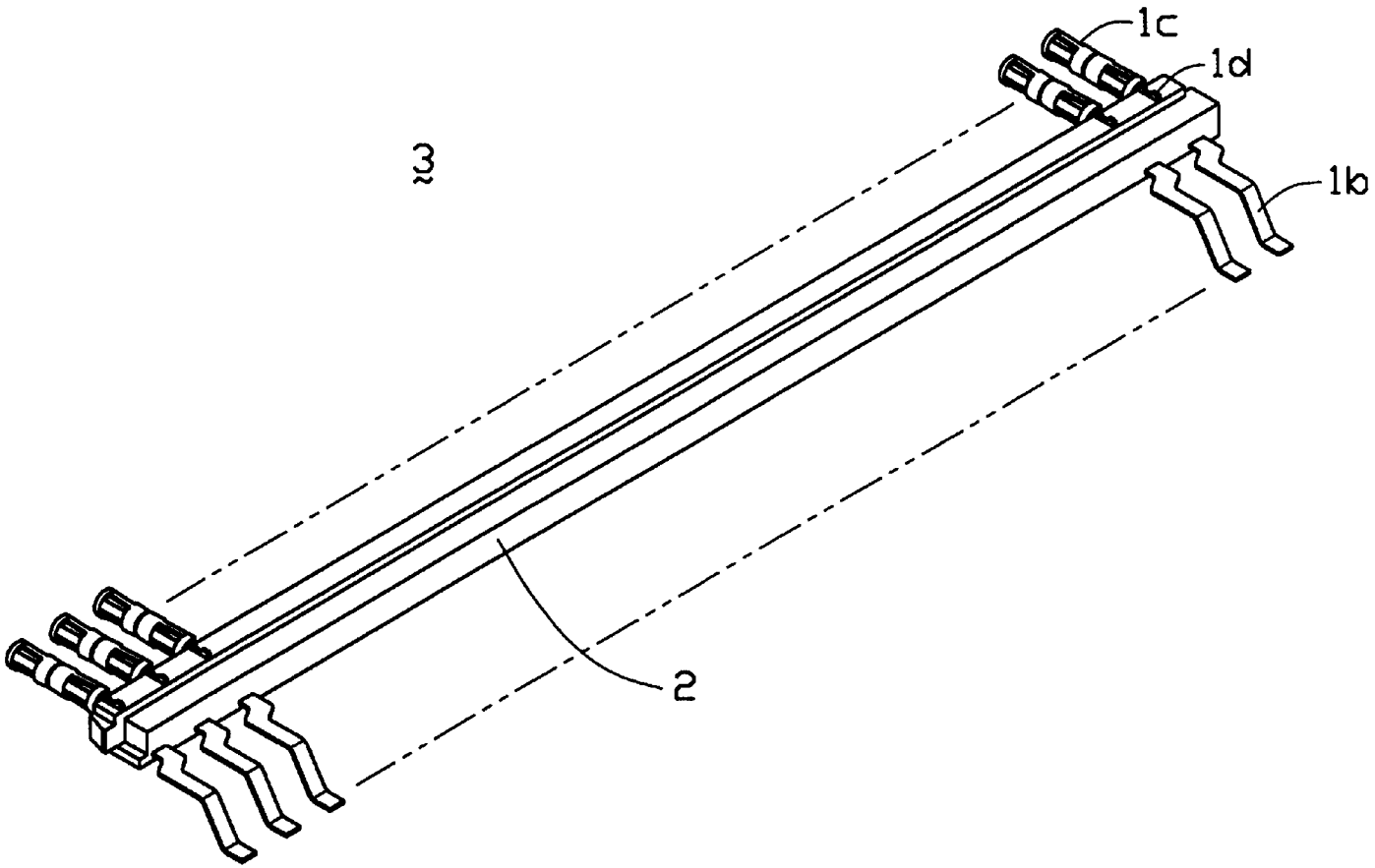
FIG. 2 is a perspective view of a connector core formed by a plurality of socket contacts and a bridging rib.

Referring to FIGS. 1 and 2, a socket contact 1 used with a connector 20 is shown. The contact 1 has been disclosed detailedly in U.S. Pat. No. 5,472,358 assigned to the same assignee and therefore no further description is given hereinafter. The socket contact 1 includes a retention portion 1*a* having a tail portion 1*b* extending rearward, and a main body 1*c* extending forward from the retention portion 1*a*. The tail portion 1*b* can be directed to different direction for different application.

A plurality of socket contacts 1 is then bonded together by a bridging rib 2 through insert-molding or other suitable process. The process is detailedly disclosed in an U.S. patent application entitled to "Method For Making An Electrical Connector", Ser. No. 09/182,832, filed on Oct. 29, 1998, assigned to the same assignee, specification is commonly enclosed for reference. The subassembly or connector core 3 of the socket contacts 1 and the bridging rib 2 can be stacked together according to the actual requirement. During the insert-molding process, each individual socket contact 1 is securely positioned in a corresponding molding cavity (not shown) wherein barbs 1*d* on one side of the socket contact 1 is firmly received in a corresponding recess thus resulting in being uncovered by the rib 2, referring to FIG. 4. Oppositely, barbs 1*d* on the other side of the socket contacts is covered by the rib 2 through a molding process. Since each socket terminal 1 is firmly positioned and aligned in the molding cavity, the tail portions 1*b* are ensured to locate in a common plane thereby facilitating smooth SMT process thereafter. After the connector core 3 is formed, two connector cores 3 can be stacked together as disclosed in the co-pending application.

Figure 3:
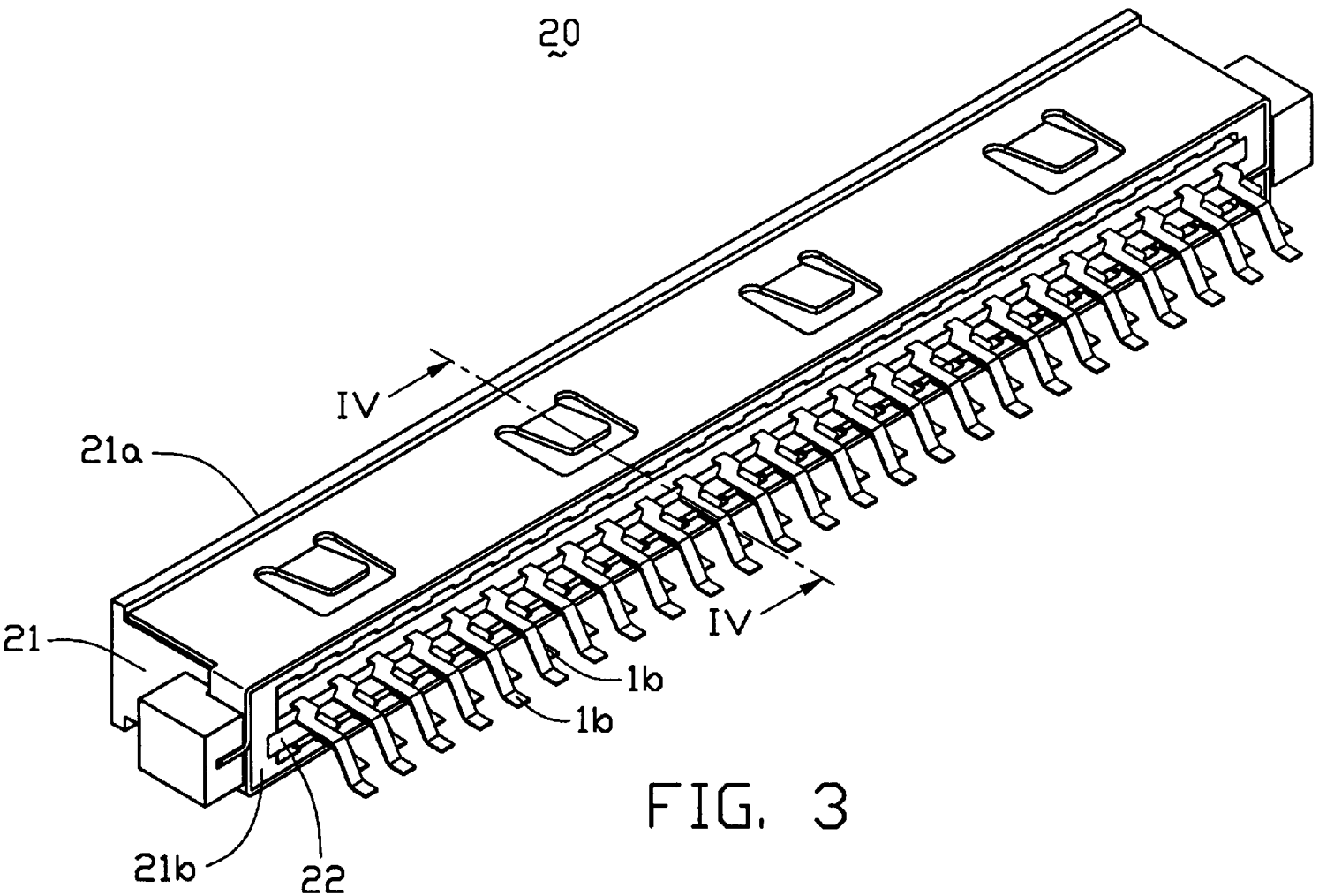
FIG. 3 is a perspective view of an electrical connector in accordance with the present invention.
Figure 4:
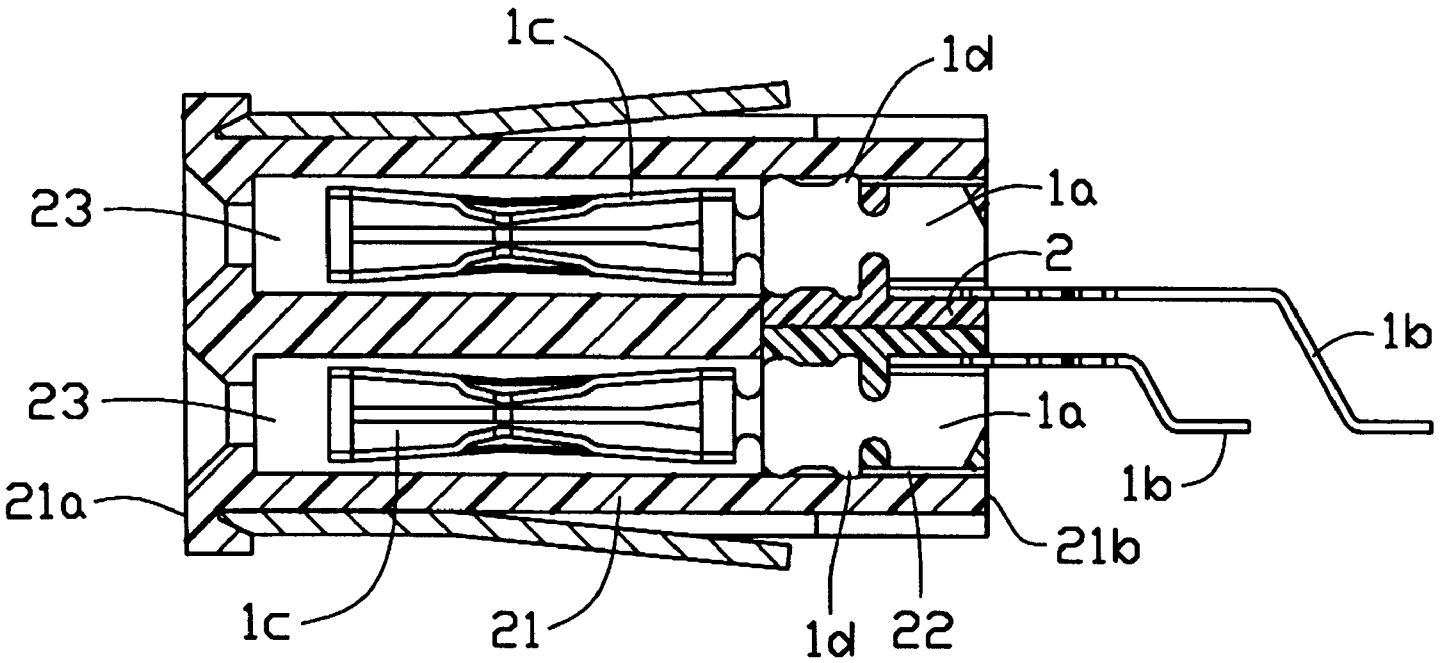
FIG. 4 is a cross sectional view taken along line 4—4 of FIG. 3.

Referring to FIGS. 3 and 4, a connector 20 in accordance with the present invention comprises a dielectric housing 21 having front 21*a* and rear surfaces 21*b*. Two elongate slots 22 are defined in the rear surface 21*b*. A plurality of passageways extends 23 from each slot 22 to the front face 21*a*. The passageways 23 are arranged in upper and lower rows. The stacked connector cores 3 are then inserted into the slot 22 with the main bodies 1*c* extending into corresponding passageway 23 of the housing 21. Since the outer barbs 1*d* are projected from the bridging rib 2, when the connector cores 3 are inserted into the slot 22, the outer barbs 1*d*, which functions as engaging means, are engaged with inner wall of the slot 22. By this arrangement, not only will the connector core 3 be firmly assembled in the housing 21, but also will ensure the coplanarity of the tail portions 1*b*. This benefits the post soldering process of the tails 1*b* to the printed circuit board. It is understood that because the rib 2 firmly encloses the most portions of the retention portion 1*a* of each contact 1, and the rib 2 snugly embedded within the slot 22 in the housing 21, the contacts 1 may be more stable with regard to the housing than that disclosed in the aforementioned U.S. Pat. No. 5,472,358.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector, comprising:

a dielectric housing having front and rear surfaces, an elongate slot defined in said rear surface, and a plurality of passageways extending from said slot to said front surface;

a bridging rib securely assembled to said elongate slot; and a plurality of terminals embedded in said bridging rib, each terminal including a retention portion integrally molded with said bridging rib, a body portion extending from said retention portion and received in said corresponding passageway, and a soldering tail extending rearward from said retention portion, wherein said retention portion includes engaging means exposed from said bridging rib and engaged with an inner wall of said elongate slot when said bridging rib is inserted into said elongate slot; further comprising an EMI shield assembled to said housing wherein said EMI shield includes a tab electrically connected to a selected one of the terminals.

2. The electrical connector as recited in claim 1, wherein said engaging means is barbs extending from said retention portion of said terminal.

* * * * *